United States Patent [19]

Otterson

[11] 4,274,563

[45] Jun. 23, 1981

[54] PLASTIC END CLOSURE FOR HERMETICALLY SEALED CONTAINER

[75] Inventor: Lewis L. Otterson, Chagrin Falls, Ohio

[73] Assignee: Weatherchem Corporation, Twinsburg, Ohio

[21] Appl. No.: 61,609

[22] Filed: Jul. 30, 1979

[51] Int. Cl.[3] ..... A47G 19/24; B65D 47/10

[52] U.S. Cl. ..... 222/480; 222/541

[58] Field of Search ..... 222/480, 541, 548, 142.9

[56] References Cited

U.S. PATENT DOCUMENTS

| | | | |
|---|---|---|---|
| 2,094,600 | 10/1937 | Hothersall | 222/548 X |
| 2,326,839 | 8/1943 | Cullen | 222/548 |
| 2,817,451 | 12/1957 | Giles et al. | 222/480 X |
| 2,961,132 | 11/1960 | Ankney | 222/480 |
| 3,143,256 | 8/1964 | Lazure et al. | 222/541 X |
| 3,281,982 | 11/1966 | Salisbury | 222/541 X |
| 3,486,665 | 12/1969 | La Croce | 222/480 |
| 3,912,128 | 10/1975 | Ziemann et al. | 222/541 |

*Primary Examiner*—F. J. Bartuska

*Attorney, Agent, or Firm*—Pearne, Gordon, Sessions, McCoy & Granger

[57] ABSTRACT

A reclosable end cap or closure is provided of the type in which a rotatable disc or cover member is pivotally connected permanently at the center region of the end cap and can be selectively rotated in sliding face-to-face contact to close or unclose openings formed in radially intermediate portions of the end cap. The openings are originally formed as closed, removable, airtight tabs and the rotatable disc is pivoted on a boss upstanding from the center of the end cap to thereby provide a hermetic seal until the closure is first opened, and to provide for reclosability thereafter.

3 Claims, 5 Drawing Figures

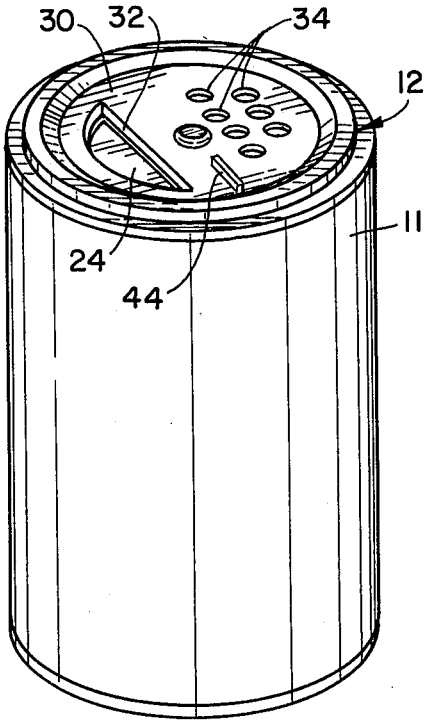
FIG. 1
FIG. 2
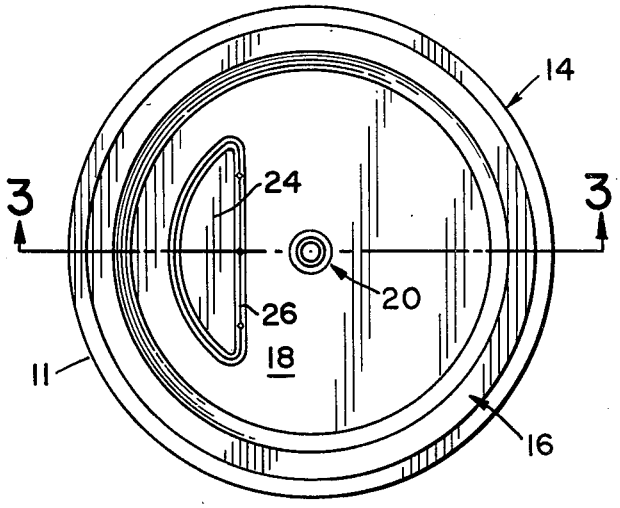
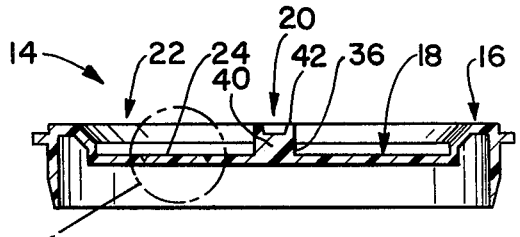
FIG. 3
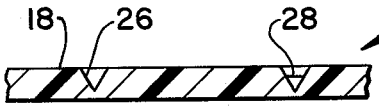
FIG. 5
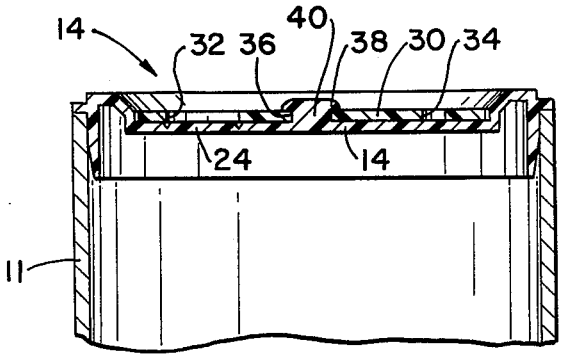
FIG. 4

PLASTIC END CLOSURE FOR HERMETICALLY SEALED CONTAINER

BACKGROUND OF THE INVENTION

This invention relates to an annular end cap structure for closing containers having a cylindrical end or neck.

In particular, the invention relates to reclosable closures of the type in which a rotatable disc or cover member is pivotally connected permanently at the center region of the end cap and can be selectively rotated in sliding face-to-face contact with the end cap to close or unclose openings formed in radially intermediate portions of the end cap--that is, openings formed in portions of the end cap that are radially intermediate the center region and the rim and exclude the center region itself.

A conventional way of providing such an end closure with a rotatable cover member is the provision of a central boss on the cover member received in a central opening in the end closure, as seen for example in La Croce U.S. Pat. No. 3,486,665. This arrangement is simple but does not provide a hermetic seal.

In many such packaging applications, in order to improve shelf life or for other reasons, it is desirable to provide a hermetic seal of the reclosable end cap prior to the first opening thereof. Heretofore, however, no simple means has been provided to accomplish this. Rather, hermetic seals for reclosable end closures which are provided with permanently associated rotary members, pivotally connected at the center of the end cap and intended to close openings at radially intermediate portions, have generally involved rather complex structures such as shown, for example, in Hothersall U.S. Pat. No. 2,094,600.

Hermetic seals have been provided in constructions with rotatable members (not discs) pivotally connected temporarily (not permanently) at the center of an end wall. Such members, however, cannot be reclosed once the hermetic seal is broken on the first opening thereof. An example is Salisbury U.S. Pat. No. 3,281,982.

The present invention provides a reclosable closure construction with a permanently associated rotary member pivotally connected at the center of the end cap and intended to close openings at radially intermediate portions, which compares in simplicity with the most simple prior art constructions such as La Croce, but which provides a hermetic seal that compares in performance to hermetic seal constructions of the prior art such as Hothersall.

The objects and advantages of the invention will be more fully understood from the following description taken together with the accompanying drawings.

In the drawings,

FIG. 1 is an isometric view of a container including a reclosable end cap structure exemplifying the invention.

FIG. 2 is a plan view of the plastic cap proper seen in FIG. 1, on a slightly enlarged scale.

FIG. 3 is a cross section taken on the plane of line 3—3 in FIG. 2.

FIG. 4 is a cross section of the entire construction taken on the same plane as FIG. 3.

FIG. 5 is a detail of FIG. 3 shown on an enlarged scale.

Shown in the drawings is a cylindrical container 11 provided with a reclosable end cap closure, generally indicated by the reference numeral 12. The reclosable end cap closure 12 includes a plastic cap proper 14

(FIG. 3) having a rim portion 16 and an end wall portion 18 generally depressed below the rim portion 16. The end wall portion 18 of the cap proper includes a center region 20 and a radially intermediate region 22 between the center region 20 and the rim portion 16.

The radially intermediate region 22 of the end wall portion 18 contains, within itself and to the exclusion of the center region 20, a tab 24 which is defined by a reduced thickness web at the bottom surface of the end wall portion 18, which in turn is defined by a V-groove 26 formed entirely within the radially intermediate region 22 of the end wall portion 18 and extending downwardly from the top surface of the end wall portion 18 toward the bottom surface of the end wall portion 18. The tab is readily breakable by manual force exerted thereon in a direction toward the interior of the container 11.

The tab 24 is joined to the remainder of the radially intermediate region 20 of the end wall portion 18 by one or more hinge pins 28 (FIG. 5) formed integrally in the end wall portion 14 and extending across the V-groove 26. With the provision of these hinge pins, the tab, after opening, can remain hinged to the remainder of the end wall so as not to drop into the contents of the container 11.

A rotatable disc or cover member 30 is provided which has one or more types of openings, such as the openings 32 and 34, which are alignable with the tab 24 or the window formed therefrom. The disc 30 is rotatably attached to the end cap proper 14 at the center region 20 with the bottom of the disc 30 in sliding face-to-face contact with the top surface of the cap proper 14, to thereby close the window formed by opening of the tab 24 when the openings 32 and 34 are turned out of alignment with such window.

A central upstanding boss 36 is formed on and is permanently integrally associated with the end wall portion 18 at the center region 20 thereof. The rotatable disc or cover member 30 is received on the upstanding boss 36 and is permanently and rotatively associated with the end wall portion 18. The bottom surface of the disc 30 is clamped in sliding face-to-face contact with the top surface of the end wall portion 18 of the cap proper 14 by retainer means which, in the illustrated example, comprises a flange 38 formed by upsetting the free end of the boss 36 (FIG. 4). The boss comprises a wall section 40 of generally increased thickness as compared to the wall section thickness at the radially intermediate region 22 of the end wall portion 18. Prior to upsetting, the boss 36 may include an upstanding rim 42 (FIG. 3) intended to supply a reservoir of material for formation of the flange 38 by upsetting.

As most clearly seen in FIG. 4, prior to original opening of the tab 24, the reclosable closure provides a hermetic seal across the mouth of the cylindrical container. After initial opening, as by pushing in the tab 24 and aligning the opening 32 or openings 34 with the resulting window, the end cap can be reclosed by rotating the disc 30 to bring all openings out of alignment with the window. The disc 30 may be provided with an upstanding gripping member 44 (FIG. 1) to aid in rotation.

The reclosable end cap closure as described may be formed by injection molding suitable plastic material. Some plastics are more permeable than others, and may not provide adequate hermetic sealing, particularly at thin sections such as the relatively thin tearing web defined between the bottom of the V-groove 26 and the bottom surface of the end wall portion 18. Suitable labels of foil or other sealing material may be applied on the underside of the end wall portion 18 to improve the seal in such instances. Such a label would, of course, be broken when the tab 24 was opened. Such a label might extend only under the region of the tab 24 or throughout the area of the end wall portion 18, or even to the rim portion 16.

The reclosable end cap closure also serves as a tamperproof indicator so that an end user can be assured that the container and its contents have not been previously opened or used.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a reclosable end cap closure container having a cylindrical end or neck, said closure including a plastic cap proper having a rim portion for sealing engagement with the end or neck of the container and an end wall portion generally depressed below the rim portion, said end wall portion of said cap proper including a center region and a radially intermediate region between said center region and said rim, said radially intermediate region of said end wall portion containing, within itself and to the exclusion of said center region, a tab, said tab being readily breakable by manual force exerted on the tab, in a direction toward the interior of a container on which the cap is placed, to open said tab and form a window, a rotatable disc with openings therein alignable with said tab or window, said disc being rotatably attached to the cap proper at said center region thereof with the bottom surface of said disc in sliding face-to-face contact with the top surface of the cap proper to close said window, after it is formed by opening of said tab, when said openings in said disc are turned out of alignment with said window, the improvement which comprises the cap proper constituting a hermetically sealed closure member prior to opening of said tab, an integral central upstanding boss formed on and permanently integrally associated with said end wall portion of said cap proper at said center region thereof, said disc being received on said upstanding boss and being permanently rotatively associated with said end wall portion, retainer means at the free end of the boss and slidably engaging the top side of the disc to thereby clamp the bottom surface of the boss-mounted disc in said sliding face-to-face contact with the top surface of said end wall portion, the height of the boss and retainer means being limited to avoid projection thereof above the plane of the upper extent of the rim portion, the disc being free of contact with structure radially outward of said end wall portion of the cap proper whereby the disc is retained on a hermetically sealed end closure prior to opening of the tab and remains rotatably associated with the end closure after opening of the tab to provide reclosability without gapping between said disc and said end wall portion and without springing of the disc from the end wall portion.

2. A device as in claim 1, the boss comprising a wall section of generally increased thickness as compared to the wall section thickness at said radially intermediate region of said end wall portion, the free end of the boss being upset to slightly extend radially over the top side of the disc to thereby provide said retaining means.

3. A device as in claim 2, said tab being joined to the remainder of said radially intermediate region of said end wall portion by one or more hinge pins formed integrally in said end wall portion and extending across a groove defining said tab whereby said tab, after opening, can remain hinged to the remainder of said end wall by at least one such hinge pin.

* * * * *